US011191315B2

(12) United States Patent
Von Dunten et al.

(10) Patent No.: US 11,191,315 B2
(45) Date of Patent: Dec. 7, 2021

(54) HELMET HAVING AN EVAPORATION COOLER

(71) Applicant: ABUS August Bremicker Söhne KG, Wetter-Volmarstein (DE)

(72) Inventors: Marc Von Dunten, Essen (DE); Matthias Ocklenburg, Darmstadt (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 0 days.

(21) Appl. No.: 16/196,879

(22) Filed: Nov. 20, 2018

(65) Prior Publication Data

US 2019/0150549 A1 May 23, 2019

(30) Foreign Application Priority Data

Nov. 21, 2017 (DE) ..... 102017127445.6

(51) Int. Cl.
*A42B 3/28* (2006.01)
*A42B 3/06* (2006.01)

(52) U.S. Cl.
CPC ..... *A42B 3/285* (2013.01); *A42B 3/066* (2013.01); *A42B 3/283* (2013.01)

(58) Field of Classification Search
CPC ..... A42B 3/281; A42B 3/283; A42B 3/285; A42B 3/286; A42B 3/066; A42B 3/28; A42B 1/008; A42B 3/0493; A42B 3/06; A42B 3/062; A42B 3/063; A42B 3/10; A42B 3/121; A42C 5/04; A61F 2007/0058; A61F 2007/0065; A61F 2007/0068; A61F 2007/0002; A61F 2007/0008
USPC ..... 2/DIG. 1
See application file for complete search history.

(56) References Cited

U.S. PATENT DOCUMENTS

| | | | | |
|---|---|---|---|---|
| 3,391,407 | A * | 7/1968 | Waters | A42B 3/286 2/171.3 |
| 3,548,415 | A * | 12/1970 | Waters | A42B 3/286 2/171.3 |
| 5,896,579 | A * | 4/1999 | Johnson | A61F 9/068 2/7 |
| 6,516,624 | B1 * | 2/2003 | Ichigaya | A41D 13/0056 62/259.3 |
| 10,512,295 | B1 * | 12/2019 | Hanson | A63B 71/10 |
| 2008/0250549 | A1 * | 10/2008 | Summers | A42B 3/281 2/425 |
| 2010/0229285 | A1 * | 9/2010 | Kindermann | A42B 3/281 2/410 |
| 2011/0094012 | A1 * | 4/2011 | Toth | A42B 3/121 2/171.2 |
| 2015/0047110 | A1 | 2/2015 | Chilson | |
| 2017/0215511 | A1 * | 8/2017 | Albani | A42B 3/24 |
| 2018/0103712 | A1 * | 4/2018 | Krishnan | A42B 3/283 |
| 2018/0153246 | A1 * | 6/2018 | Baldi | A42B 3/04 |
| 2018/0255862 | A1 * | 9/2018 | Ho | A42B 3/12 |

(Continued)

FOREIGN PATENT DOCUMENTS

| | | | |
|---|---|---|---|
| CN | 106805345 | A | 6/2017 |
| CN | 106974351 | A | 7/2017 |

(Continued)

*Primary Examiner* — Amy Vanatta
(74) *Attorney, Agent, or Firm* — Dinsmore & Shohl LLP

(57) ABSTRACT

A helmet, in particular to a bicycle helmet, having a plurality of ventilation openings and at least one evaporation cooler that is arranged in a ventilation opening.

13 Claims, 1 Drawing Sheet

(56) References Cited

U.S. PATENT DOCUMENTS

| | | | | |
|---|---|---|---|---|
| 2019/0021433 | A1* | 1/2019 | Goldwitz | A42B 3/285 |
| 2019/0343215 | A1* | 11/2019 | Musal | A42B 3/281 |
| 2020/0054090 | A1* | 2/2020 | Chen | A42B 3/065 |

FOREIGN PATENT DOCUMENTS

| | | | |
|---|---|---|---|
| DE | 6073 | A | 7/1879 |
| DE | 2921354 | A1 | 12/1980 |
| DE | 19615049 | A1 | 10/1997 |
| DE | 19845916 | A1 | 4/2000 |
| DE | 202010014772 | U1 | 12/2010 |
| KR | 20110006313 | U | 6/2011 |

* cited by examiner

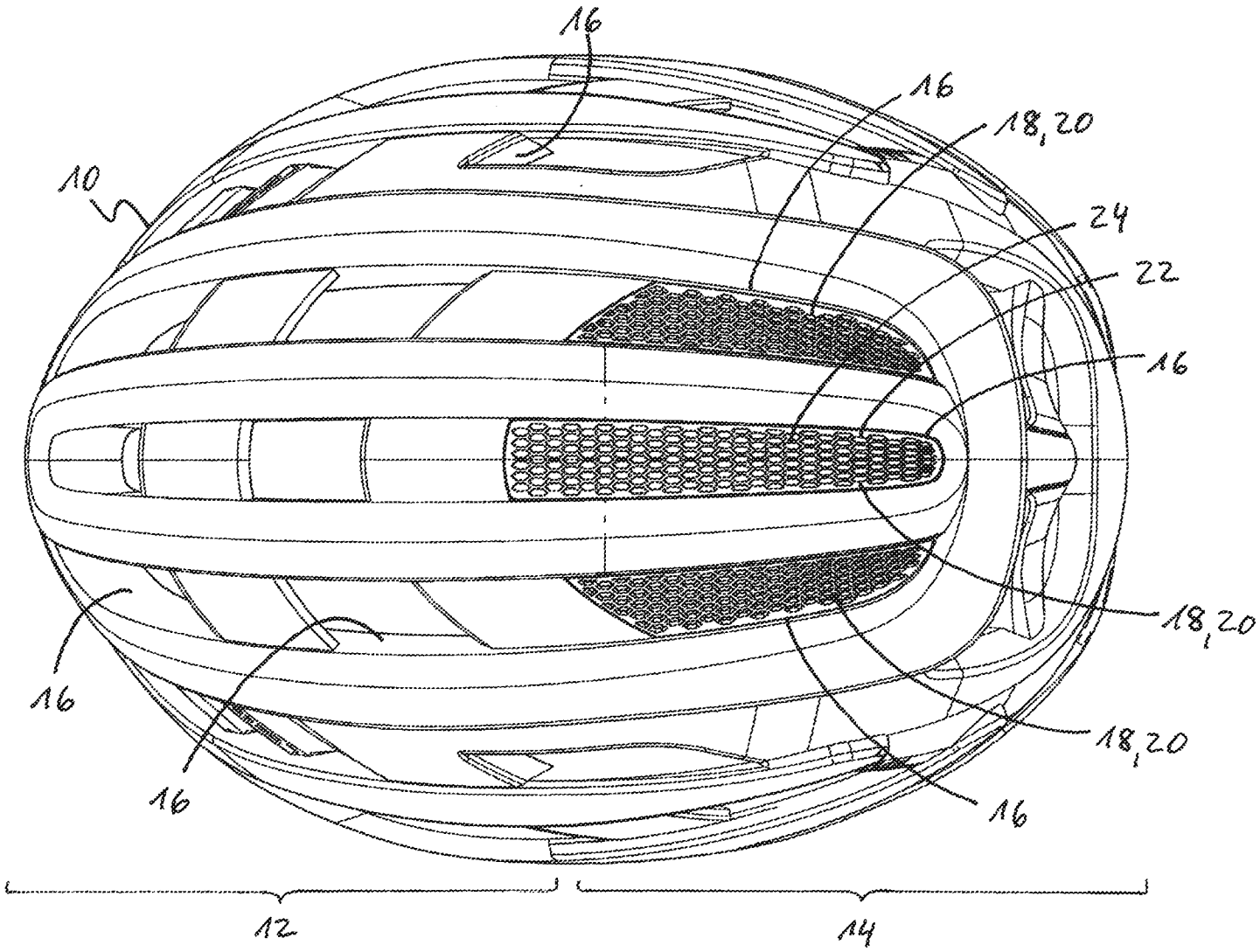
10
12
14
16
18, 20
22
24

HELMET HAVING AN EVAPORATION COOLER

CROSS-REFERENCE TO RELATED APPLICATIONS

This application claims priority to German Patent Application No. 102017127445.6 filed Nov. 21, 2017, which is incorporated herein by reference in its entirety including the specification, drawings, and abstract.

TECHNICAL FIELD

The present disclosure relates to a helmet, in particular a bicycle helmet, having a plurality of ventilation openings.

BACKGROUND

A bicycle helmet having a plurality of ventilation openings is generally known. The ventilation openings serve to conduct air, in particular in the form of headwind, to the head of a wearer of the helmet to provide a certain cooling of the head in this manner.

It is the object of the present disclosure to further improve the comfort in wear of a helmet of the initially named kind in a simple and inexpensive manner.

SUMMARY

The object is satisfied by a helmet having at least one evaporation cooler arranged in a ventilation opening.

It is the general idea underlying the present disclosure not to restrict the cooling function of the helmet to simple air circulation through the ventilation openings, but rather to additionally support it by an evaporation cooler that is provided just for this purpose and that works purely passively in accordance with the principle of cooling by drying and evaporating. The cooling of the head of a helmet wearer is significantly increased in this manner and the comfort in wear of the helmet is increased overall.

The activation of the evaporation cooler, more precisely the loading of the evaporation cooler with cooling fluid, may take place in a simple manner in practice in that the helmet wearer wets the evaporation cooler with cooling fluid, for example in that he pours or sprays drinking water from a cup or from a bottle onto the evaporation cooler. In contrast, to deactivate the evaporation cooler, for example while riding downhill, the helmet wearer only has to lower his head and to position the evaporation cooler in the headwind such that cooling fluid collected in the evaporation cooler is actively driven out of the evaporation cooler.

In accordance with an embodiment, the evaporation cooler is arranged in a ventilation opening that is in a rear region of the helmet or is at least arranged in a section of a ventilation opening that is in a rear region of the helmet. In this way, the evaporation cooler does not impede the entry of cooling air in the front region of the helmet that is normally directly exposed to the headwind, but rather amplifies the cooling in a rear region of the helmet that conventionally tends to be moderately cooled. The arrangement of the evaporation cooler in the rear region of the helmet provides that the cooling fluid does not run into the eyes of the helmet wearer when he pours or sprays cooling fluid over the evaporation cooler. It is understood that an evaporation cooler may, however, generally also project far into the front region of the helmet or may be arranged completely in the front region of the helmet.

Providing a plurality of ventilation openings with a respective evaporation cooler contributes to an even better cooling.

In some embodiments, the evaporation cooler has a plurality of evaporation openings that are bounded by webs of the evaporation cooler. The surface available for the drying and evaporation of the cooling fluid is maximized in this manner and the cooling effect of the evaporation cooler is consequently optimized.

In some embodiments, the evaporation openings are elongated in character. Such an elongate characteristic of the evaporation openings promotes the surface tension effect and thus facilitates the spanning of the evaporation openings by a cooling fluid film. The longitudinal orientation of the evaporation openings may be aligned with the longitudinal orientation of the helmet so that headwind may ideally access the evaporation cooler and may thereby ideally dry and evaporate the cooling fluid collected in the evaporation cooler.

In accordance with a first embodiment, the evaporation cooler comprises a lattice structure that is in particular bend-proof. The lattice structure may have a thickness in the range of a plurality of millimeters, or 1 to 2 millimeters.

The lattice structure defines a plurality of evaporation openings that are dimensioned such that they may be spanned by a film of a cooling fluid, in particular by a film of drinking water. In this manner, not only webs of the evaporation cooler bounding the evaporation openings may be wetted by cooling fluid, but the evaporation openings may additionally be spanned by a cooling fluid film, whereby the evaporation cooler may take up more cooling fluid overall and may ultimately cool even more effectively. The lattice structure to this extent furthermore satisfies a dual function in that it cannot only store cooling fluid, but may also contribute to an ideal air flow through the helmet.

In some embodiments, the lattice structure includes columns extending over the total length of the lattice structure in the longitudinal direction of the helmet.

In some embodiments, the evaporation openings each have a hexagonal shape. The honeycomb lattice structure resulting from this is characterized by a particularly successful compromise of stability and a spatially ideal arrangement of the evaporation openings. In some other embodiments, different angular shapes for the evaporation openings may also be considered. For example, round evaporation openings, and/or elliptical evaporation openings, and in some embodiments, the round evaporation openings and/or elliptical evaporation openings are arranged in an orthogonal or cross pattern.

In some embodiments, the evaporation openings may have a maximum width of 1.5 mm, 1.3 mm, or 1.2 mm, since the surface tension of drinking water is normally sufficient to form water films spanning such wide evaporation openings.

The length of the evaporation openings may be selected as longer than the width and may, for example, lie in the range of a plurality of millimeters, such as in the range from 2 to 10 mm, or the range from 3 to 6 mm.

In accordance with a second embodiment, the evaporation cooler comprises a sponge element, in particular an element composed of an open cell foam material and/or an element composed of a three-dimensional textile fabric. Such an evaporation cooler is also easily suited to take up a cooling fluid such as drinking water that is provided for cooling by drying and evaporation. It is understood that the evaporation cooler may generally also have a combination of a lattice structure, a sponge element and/or a textile fabric.

BRIEF DESCRIPTION OF THE DRAWINGS

The present disclosure will be described in the following purely by way of example with reference to an embodiment and to the enclosed drawing.

FIG. 1 shows a plan view from above of a helmet in accordance with the present disclosure.

DETAILED DESCRIPTION

The helmet 10 shown in FIG. 1 is a bicycle helmet that has a front region 12 and a rear region 14. The terms "front" and "rear" in this context relate to the perspective of a wearer of the helmet 10, that is the front region 12 of the helmet 10 seated on the head of the helmet wearer faces in the direction of gaze of the helmet wearer, whereas the rear region 14 covers the back of the helmet wearer's head.

The helmet 10 comprises a plurality of ventilation openings 16. Three of these ventilation openings 16 have an elongate design oriented in the longitudinal direction of the helmet 10 and predominantly extent in the rear region 14 of the helmet 10.

An evaporation cooler 18 that is formed by a bend-proof lattice structure 20 in the embodiment shown is inserted into each of these three ventilation openings 16. Each lattice structure 20 has a thickness of approximately 1.5 mm and defines a plurality of evaporation openings 22 that are bounded by webs 24 of the lattice structure 20. The evaporation openings 22 each have a hexagonal cross-section. The length of each evaporation opening 22 here amounts, viewed in the longitudinal direction of the helmet 10, to approximately 4 mm, whereas the maximum width amounts to approximately 1.3 mm.

With this dimensioning of the evaporation openings 22, a water film wetting the lattice structure 20 may also span the evaporation openings 22 due to its surface tension when the lattice structure 20 has water poured or sprayed onto it, from a drinking bottle, for example, during the trip by the helmet wearer, for example an additional cooling is achieved in the rear region 14 of the helmet 10 that considerably increases the comfort in wear of the helmet 10 as a consequence of the drying and evaporating of the water, not least promoted by the headwind.

The invention claimed is:

1. A helmet having a plurality of ventilation openings and at least one evaporation cooler that is arranged in a ventilation opening, wherein the evaporation cooler only comprises a lattice structure that defines a plurality of evaporation openings that are bounded by webs of the evaporation cooler, the plurality of evaporation openings are dimensioned to be spanned by a film of a cooling fluid, wherein the lattice structure is bend-proof, wherein the evaporation openings each have a hexagonal shape.

2. The helmet in accordance with claim 1, wherein the helmet is a bicycle helmet.

3. The helmet in accordance with claim 1, wherein the evaporation cooler is arranged in a ventilation opening that is in a rear region of the helmet.

4. The helmet in accordance with claim 1, wherein the evaporation cooler is arranged in a section of a ventilation opening that is in a rear region of the helmet.

5. The helmet in accordance with claim 1, wherein a plurality of ventilation openings are each provided with an evaporation cooler.

6. The helmet in accordance with claim 1, wherein the evaporation openings are of an elongate character.

7. The helmet in accordance with claim 1, wherein the cooling fluid is drinking water.

8. The helmet in accordance with claim 1, wherein the evaporation openings have a maximum width of 1.5 mm.

9. The helmet in accordance with claim 8, wherein the evaporation openings have a maximum width of 1.3 mm.

10. The helmet in accordance with claim 9, wherein the evaporation openings have a maximum width of 1.2 mm.

11. The helmet in accordance with claim 1, wherein the evaporation openings have a length of a plurality of millimeters.

12. The helmet in accordance with claim 11, wherein the evaporation openings have a length in the range from 2 to 10 mm.

13. The helmet in accordance with claim 12, wherein the evaporation openings have a length in the range from 3 to 6 mm.

* * * * *